United States Patent [19]

Chen et al.

[11] Patent Number: 4,513,453

[45] Date of Patent: Apr. 30, 1985

[54] PRE-TIED NECKTIE

[76] Inventors: Jiann Chen; Ching H. Chen, both of No. 21, Alley 21, La. 244, Sec. 5, Yen-Ping North Rd., Taipei, Taiwan

[21] Appl. No.: 496,057

[22] Filed: May 19, 1983

[51] Int. Cl.[3] ..... A41D 25/08

[52] U.S. Cl. ..... 2/150; 2/153

[58] Field of Search ..... 2/144, 145, 149, 150, 2/152 R, 152 A, 153, 155

[56] References Cited

U.S. PATENT DOCUMENTS

| | | | |
|---|---|---|---|
| 2,247,184 | 6/1941 | Burfening | 2/150 |
| 2,294,508 | 9/1942 | Minor | 2/150 |
| 3,127,618 | 4/1964 | Roach | 2/150 |
| 3,284,807 | 11/1966 | Espino | 2/153 |
| 3,363,264 | 1/1968 | Mathison | 2/150 |
| 4,024,585 | 5/1977 | Girdler | 2/153 |
| 4,337,539 | 7/1982 | Najarian | 2/153 |

FOREIGN PATENT DOCUMENTS

| | | | |
|---|---|---|---|
| 352640 | 4/1961 | Switzerland | 2/155 |

*Primary Examiner*—Louis K. Rimrodt

*Attorney, Agent, or Firm*—Cantor and Lessler

[57] ABSTRACT

Disclosed is a novel pre-tied necktie having an inner tie with one end formed as a flexible opening and zip fastener disposed therein, an outer tie containing a wide end of a conventional necktie, and a knot support with a hole near the lower end of the front wall. The upper end of the outer tie and the slider plate of the zip fastener are fixed in the hole of the knot support. When the knot is preset upon the support, the necktie can be donned with one hand. If necessary a M-shaped clamping device can be mounted on the support and thereby enhance its stability.

5 Claims, 6 Drawing Figures

Fig. 2
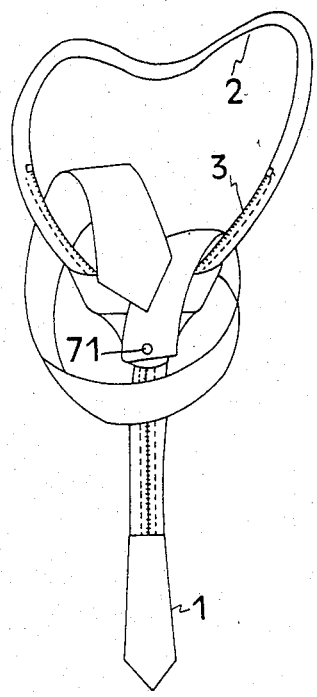
Fig. 1
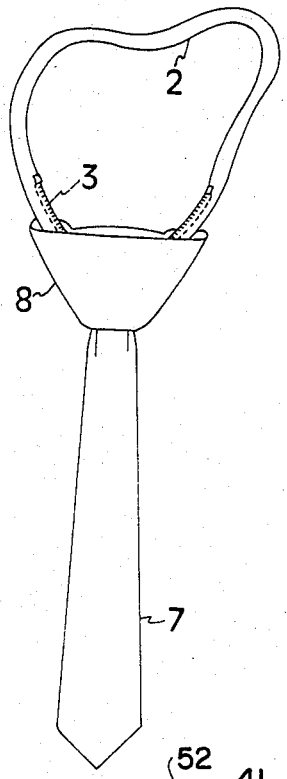
Fig. 3
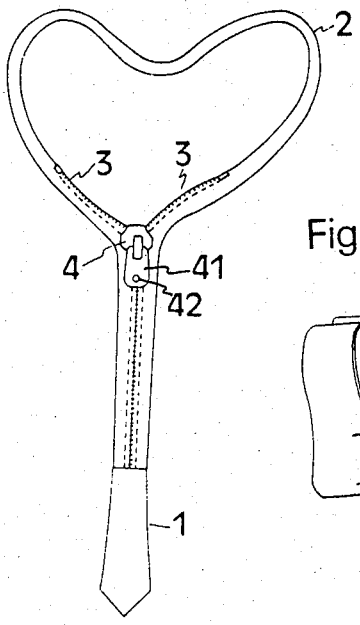
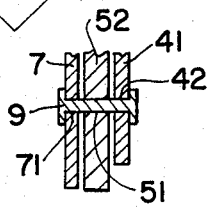
Fig. 6
Fig. 5
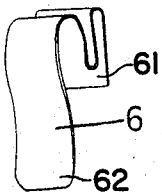
Fig. 4
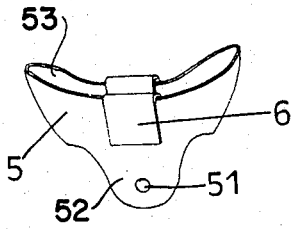

PRE-TIED NECKTIE

The invention is concerned with a novel necktie, particularly one which is pre-tied.

A conventional necktie is time consuming and troublesome to tie each time. As a kind of necktie free from tying, suggestion has been made of using a rope connected to a preset knot and is clasped behind the neck, such as a necklace. Yet as one is unable to see while the engagement is being done, the operation is inconvenient. In addition, the size is fixed and may be impractical. Another suggestion has been to use an elastic band as the flexible opening of the tie but as it does not have the stability, the tie knot may be slanted relative to its position, nevertheless, the elastic band will press against the neck and create an uncomfortable feeling.

This invention is free of the above defects in a conventional tie. Accordingly this invention provides a necktie free from tying and easy to be donned with only one hand.

According to the invention, the necktie comprises an inner tie with its upper end formed as a flexible opening and having a zip fastener disposed it; an outer tie with a hole near its upper end, and a knot support with a hole in its lower end of the front wall.

The hole of the slider plate of the zip fastener and the upper end of the outer tie are fixed by means such as a rivet, in said hole of the knot support. In order to enhance its stability, a clamping means may be mounted upon the knot support.

Other and further objects, features and advantages of the invention will appear more fully from the following description.

FIG. 1 is a perspective view of the necktie according to the invention;

FIG. 2 shows one form of operational diagram for tying the necktie according to the invention;

FIG. 3 is a front view of the inner tie;

FIG. 4 is a perspective view of the knot support with the clamp mounted thereon;

FIG. 5 is a rear perspective view of an embodiment of the M-shaped clamp; and FIG. 6 is a cross-sectional view, partly broken away, of a portion of the assembly.

Referring now to the drawings, and particularly to FIG. 3, an inner tie 1 comprises at its lower end a narrow end, which is similar to a conventional tie, with another end formed as a flexible opening and disposed beneath the opening a zip fastener 3. When the slider plate 41 attached unto a slider 4 is moved downwardly, the strips of the fastener 3 will then become extensions of the flexible opening 2. The size of the opening 2 is, thereby, controlled by use of slider plate 41. At the lower end of the slider plate 41 there is the hole 42. The outer tie 7 is the same as a wide end of a conventional tie, and at its upper end there is further provided a hole 71. A knot support 5, as shown in FIG. 4, has a hollow slightly oval shape when seen in its plan view and a depending tongue portion 52 is provided with a hole 51 in its lower end. Optionally a cross-sectionally M-shaped clamp 6 with a long end and a short end as shown in FIG. 5 may be used.

In assembling, inner tie 1 passes through the hollow space 53 of knot support 5 and hole 71 of outer tie 7 and hole 42 of slider plate 41 are fixed by suitable means to hole 51 of knot support 5. For example a rivet 9 may be used as the fixing means as shown in FIG. 6. Outer tie 7 is tied by a conventional method to form a preset knot such as shown in FIG. 1. As an example, the tying may be performed as shown in FIG. 2. However the knot may be preformed in the factory or before use, thus the user will not have to tie it again. To enhance the stability of the tie, it is optional to mount clamp 6 on knot support 5, as shown in FIG. 4, with said the end 61 in the front and the long end 62 at the back side.

To use the novel tie according to the invention, after the opening 2 is placed over the wearer's head and located around his neck, the flexible opening 2 is closed up by holding the preset knot 8 and putting it inside the collar of the shirt and pulling the inner tie 1 downwardly to adjust the length. Since the plate 41 and the outer tie 7 are fixed on the knot support 5, when the inner tie 1 is pulled down, the zip fastener 3 will close upwardly and thereby decrease the size of the opening.

When the necktie is to be taken off, the user holds the knot and pulls it downwardly, the opening 2 becomes larger and thereby facilitate taking the tie off. The tie of the invention is easy to be used and it is of practical use.

It is to be understood that the form of the invention shown herein and described is to be taken as a preferred example of the same and the various changes and modifications may be made without departing from the scope of the invention.

What is claimed is:

1. A necktie comprising an inner tie member, the upper end of said inner tie member being formed as a loop defining a neck-encircling opening; a zip fastener operatively mounted on said loop to enlarge and decrease the size of said opening, said zip fastener comprising a slide member having a slider plate attached thereto; a knot support having a hollow upper portion which is generally oval when viewed from above and tapers downwardly to a depending tongue; and an outer tie member; said inner tie member being disposed within said hollow knot support with the lower end thereof depending from the knot support; the upper end of said outer tie member, said knot support, and said slider plate being joined, each to the others, by fixing means; said outer tie member being formed into a knot around said knot support.

2. The necktie according to claim 1 further comprising a clamping means mounted on said knot support thereby to enhance its stability.

3. The neck tie according to claim 2, wherein said clamping means is essentially M-shaped in cross-section with one leg of the M being longer than the other leg.

4. The necktie according to claim 1, wherein said fixing means is a rivet.

5. The necktie according to claim 4, wherein each of said slider plate, said depending tongue, and said upper end of said outer tie member has a hole therein, said holes are juxtaposed, and said rivet passes through said holes.

* * * * *

REEXAMINATION CERTIFICATE (795th)

United States Patent [19]

[11] B1 4,513,453

Chen et al.

[45] Certificate Issued Dec. 8, 1987

[54] PRE-TIED NECKTIE

[76] Inventors: Jiann Chen; Ching H. Chen, both of No. 21, Alley 21, La. 244, Sec. 5, Yen-Ping North Rd., Taipei, Taiwan

Reexamination Request:
No. 90/001,140, Dec. 15, 1986

Reexamination Certificate for:

| | |
|---|---|
| Patent No.: | **4,513,453** |
| Issued: | **Apr. 30, 1985** |
| Appl. No.: | **496,057** |
| Filed: | **May 19, 1983** |

[51] Int. Cl.[4] ..... A41D 25/08
[52] U.S. Cl. ..... 2/150; 2/153
[58] Field of Search ..... 2/150, 152 R, 152 A, 2/153

[56] References Cited

U.S. PATENT DOCUMENTS

| | | | |
|---|---|---|---|
| 3,284,807 | 11/1966 | Espino | 2/153 |
| 3,898,698 | 8/1975 | Byrd et al. | 2/150 |
| 3,942,192 | 3/1976 | Harris | 2/152 R |
| 4,024,585 | 5/1977 | Girdler | 2/153 |
| 4,337,539 | 7/1982 | Najarian | 2/153 |

*Primary Examiner*—Louis K. Rimrodt
*Attorney, Agent, or Firm*—Wegner & Bretschneider

[57] ABSTRACT

Disclosed is a novel pre-tied necktie having an inner tie with one end formed as a flexible opening and zip fastener disposed therein, an outer tie containing a wide end of a conventional necktie, and a knot support with a hole near the lower end of the front wall. The upper end of the outer tie and the slider plate of the zip fastener are fixed in the hole of the knot support. When the knot is preset upon the support, the necktie can be donned with one hand. If necessary a M-shaped clamping device can be mounted on the support and thereby enhance its stability.

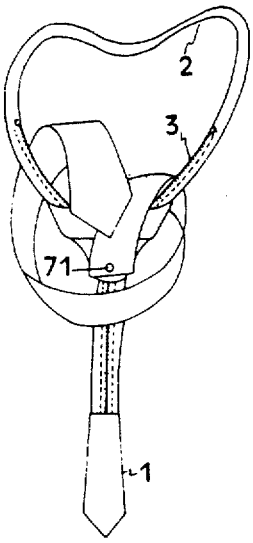

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-5 is confirmed.

* * * * *